United States Patent [19]

Lewis

[11] Patent Number: 4,776,456

[45] Date of Patent: Oct. 11, 1988

[54] BRUSH HOLDER

[76] Inventor: Lawrence A. Lewis, 285 Sunset Ave., Englewood, N.J. 07036

[21] Appl. No.: 47,773

[22] Filed: May 8, 1987

[51] Int. Cl.[4] ..... A45D 44/18

[52] U.S. Cl. ..... 206/15.3; 206/15.2; 206/229; 206/806

[58] Field of Search ..... 206/229, 15.2, 15.3, 206/806

[56] References Cited

U.S. PATENT DOCUMENTS

| | | | |
|---|---|---|---|
| 851,443 | 4/1907 | Schmidt | 206/15.3 |
| 1,857,407 | 5/1932 | Seyforth | 206/15.3 |
| 2,782,909 | 2/1957 | McNamara | 206/15.3 |
| 3,433,712 | 3/1969 | Gerarde | 206/229 |
| 4,047,329 | 9/1977 | Holt | 220/69 |
| 4,187,885 | 2/1980 | Kahler | 220/69 |

*Primary Examiner*—Joseph Man-Fu Moy
*Attorney, Agent, or Firm*—Brooks Haidt Haffner & Delahunty

[57] ABSTRACT

A toilet brush holder provided with a container for the brush and a cover having a frictional fit with the upper end of the container but which can be manually removed and applied to the lower end of the container to act as a supporting base for the container. The cover has a central opening through which the handle of the brush, but not the brush itself, can pass. The frictional fit of the cover and the container is such that the holder with the brush in the container can be suspended by the brush handle without detaching the cover from the container. The container has a projection at its lower end which fits into the opening in the cover when the cover is applied to the lower end of the container to act as a base.

2 Claims, 1 Drawing Sheet

Fig. 1.
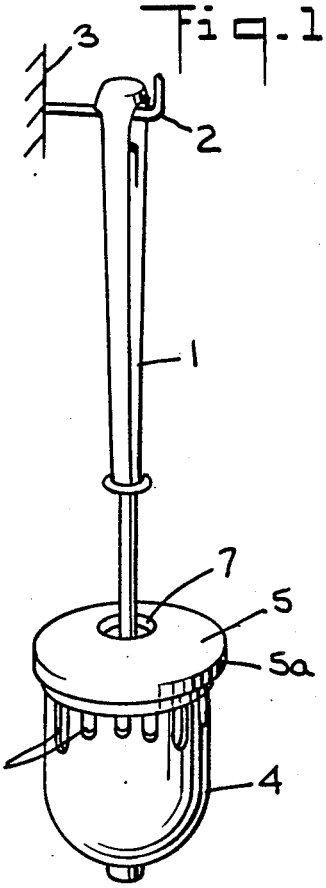
Fig. 3.
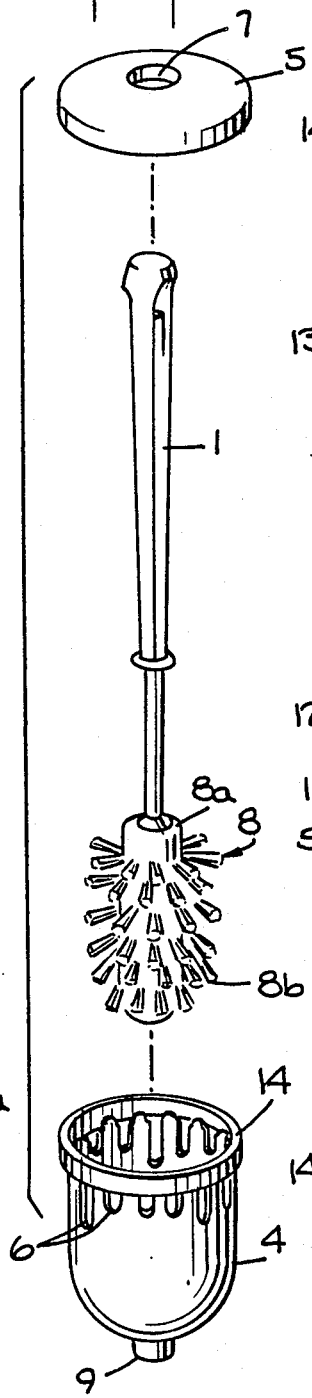
Fig. 4.
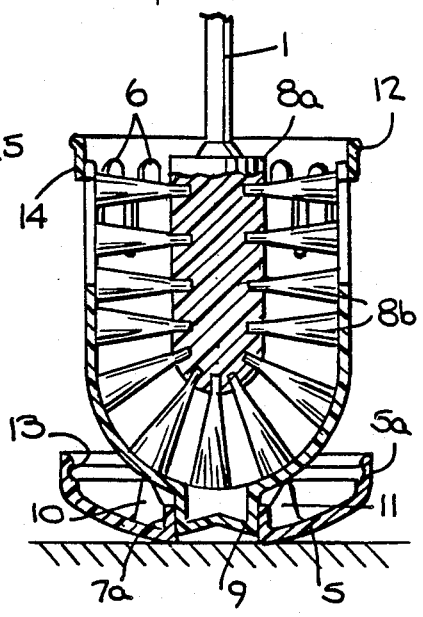
Fig. 6.
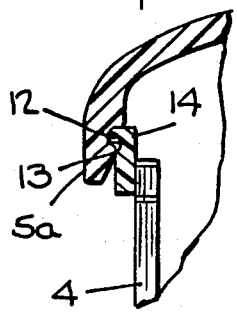
Fig. 5.
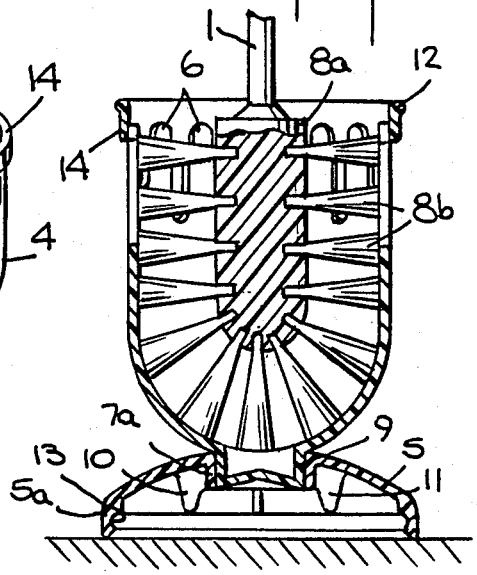
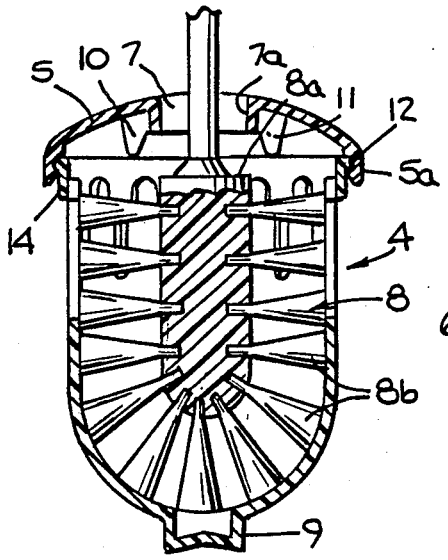
Fig. 2.

BRUSH HOLDER

This invention relates to brush holders and particularly to a holder for a toilet bowl brush.

Generally speaking, holders for toilet brushes are provided with a structure such that the holder will hold the brush in an upright position when the base of the holder rests on a floor. Such structure requires a holder with a base adequate to maintain the brush in the upright position and hold it in such position against the weight of the brush itself. Accordingly, the base must be relatively large and normally is integral with the holder. Frequently, the brush is sold with the holder and is displayed with the holder. To display such a brush with its holder in a retail store, the brush and holder are normally placed on a shelf. Because of the size of the base, the brush and holder combination occupies a substantial amount of space which limits the amount of goods which can be displayed. With the prior art structures, it has not been possible to suspend the combination by the handle of the brush because either there is nothing on the holder to engage the brush or if a cover is provided, it does not engage the holder with sufficient force to permit suspension of the holder from the brush.

One object of the invention is to provide a brush holder which permits the holder in combination with the brush to be suspended by the handle of the brush and thereby eliminate the need to display the combination on a shelf.

In accordance with the invention, the brush holder comprises a container for receiving the brush and a cover which, when the combination of the brush and the holder is displayed, engages a portion of the brush and also engages the holder with sufficient force to permit the brush and the holder to be suspended by the brush handle. Such cover is removable and is used as the base of the holder when the holder and brush combination is in use.

In the preferred embodiment of the invention, the cover of the brush holder has a snap fit with the top of the container and has an opening through which the handle of the brush extends. The cover engages a portion of the brush and has a frictional fit with the top of the container sufficient to prevent detachment of the cover from the container when the holder is suspended by the handle of the brush. However, the cover is manually detachable from the container and serves as the base for the holder when it is removed from the container at the end thereof which it engages when the brush and holder combination is being displayed by suspending the combination by the handle of the brush. Thus, when the holder is put into use, the cover is removed from the container and is then applied to the base of the container for supplying support for the holder in use.

Other objects and advantages of the present invention will be apparent from the following detailed description of the present preferred embodiment thereof, which description should be considered in conjunction with the accompanying drawing in which:

FIG. 1 is a side elevation view of the holder of the invention in combination with a brush and illustrating the combination suspended by the handle of the brush;

FIG. 2 is an enlarged fragmentary cross-section of the embodiment shown in FIG. 1 with the brush resting in the brush container;

FIG. 3 is an exploded view of the combination illustrated in FIG. 1;

FIG. 4 is a fragmentary view in partial cross-section illustrating the cover of the holder of the invention in place at the bottom end of the container when the holder is in use and mounted on a support such as floor;

FIG. 5 is similar to FIG. 4, but illustrates a preferred alternative position of the cover with respect to the container; and FIG. 6 is a fragmentary enlarged cross-sectional view illustrating a preferred construction for a snap fit of the cover with respect to the upper end of the brush container.

FIG. 1 illustrates the handle 1 of a brush engaging and suspended from a hook 2 extending through an opening in the handle 1 and secured to a fixed member 3 such as a wall of a display unit. The container 4 of the holder receives the brush portion 8 attached to the handle 1 and has a cover 5 with a rim 5*a* which has a snap fit with the upper end of the container 4.

Preferably, the container 4 has a plurality of slots 6 for ventilation and drying purposes, and the cover 5 has an opening 7 of a size sufficient to permit the handle 1 to pass therethrough. However, the opening 7 is small enough to prevent passage therethrough of the brush 8 or the upper end portion of the support 8*a* for the rristles of the brush 8.

As seen in FIG. 2, the support 8*a* has bristles 8*b* extending therefrom and received in the container 4. The container 4 has an open upper end and an extension or projection 9 at its lower end for purposes hereinafter described.

Preferably, the container 4 and the cover 5 are made of a plastic material such as polyethylene or polypropylene and to provide adequate stiffness for the cover, the cover 5 is provided with stiffening ribs 10 and 11, only two such ribs being illustrated in FIGS. 2, 4 and 5.

Although it may be sufficient to have only a friction fit between the cover 5 and the container 4, preferably the container 4 is provided with a rib 12 (see FIGS. 2–6) which is received in an internal peripheral groove 13 of the cover 5 (see FIG. 6) to provide a snap fit between the cover 5 and the container 4 and thereby assure that the cover 5 will not be separated from the container 4 when the combination of the cover 5 and the container 4 are suspended by the brush handle 1. Of course, as an alternative, the cover 5 may be provided with an internal rib which extends into a peripheral groove in the container 4.

Preferably, for molding purposes, the lower cup-shaped part of the container 4 is made as one unit and the part of the container 4 having the rib 12 is made as a separate ring 14 which is attached to such lower part of the holder 4 by any conventional method, such as by welding or adhesive.

When the brush and holder combination is being displayed, it can be suspended by the handle 1 as indicated in FIG. 1. However, when the holder is in use, the cover 5 is separated from the top of the container 4 and is applied to the base of the container 4 either in the position shown in FIG. 4 or preferably, in the position shown in FIG. 5. Thus, in addition to being of a size which will permit the passage of the handle 1, the opening 7 has a size relative to the size of the projection 9, such that there is a friction fit between the side wall 7*a* of the opening 7 and the exterior of the projection 9 so that the cover 5 may be pushed over the projection 9 either into the position shown in FIG. 4 or in FIG. 5. In such positions, the cover 5 acts as a base for the holder 4 to prevent tipping thereof when the brush 8 is inserted in the holder 4 as illustrated in FIGS. 4 and 5.

Although the brush holder of the invention has the advantage that the brush and holder may be suspended by the brush handle 1 for display purposes, it will be apparent that the brush and holder may also be displayed in a conventional manner on a shelf as shown in FIGS. 4 and 5.

Although the preferred embodiment of the invention has been illustrated, it will be apparent to those skilled in the art that various functionally equivalent modifications of the container 4 and the cover 5 may be made. For example, the rib 12 may be directed inwardly of the ring 14 and the cover 5 with a peripheral groove for receiving such rib 12 may be dimensioned so that the rim of the cover 5 fits within the ring 14. Similarly, the wall 7*a* may extend from the cover 5 in the direction opposite to the one illustrated, and the projection 9 may extend inwardly of the container 4 and have an inner size which frictionally engages the outer surface of the wall 7*a*.

I claim:

1. A holder for a brush having an elongated handle and an enlarged bristle support portion with bristles extending therefrom and at one end of said handle, said enlarged portion having an exterior size greater than the exterior size of said handle, said holder comprising:

a container for receiving said enlarged portion, said container having an open upper end, a lower end, a side wall and a bottom wall at said lower end and having a plurality of slots extending through said side wall, a cover engaging said upper end of said container, said cover having an opening therethrough of a size which permits the passage of said handle therethrough but which prevents the passage of said enlarged portion therethrough and said cover being proportioned in relation to said upper end of said container so that said cover remains engaged with said container when said enlarged portion is in said container and said brush and said container with said cover in engagement with said upper end of said container are suspended by said handle but so that said cover may be removed manually from said upper end of said container; and said container having a projection at its lower end which fits within said opening in said cover and frictionally engages the inner surface of the wall of said opening when said cover is removed from said upper end of of said container and is disposed at said lower end of said container whereby said cover forms a supporting base for said container and stably maintains said container with said member therein in a position in which said handle extends vertically with the lower surface of said cover engaging a support.

2. A holder for a brush having an elongated handle and an enlarged bristle support portion with bristles extending therefrom and at one end of said handle, said enlarged portion having an exterior size greater than the exterior size of said handle, said holder comprising:

a container for receiving said enlarged portion, said container having an open upper end and a lower end, and said container being formed by a lower cup-shaped part which is arcuate in cross-section and a ring extending around the upper end of said lower cup-shaped part;

a cover engaging said upper end of said container, said cover having an opening therethrough of a size which permits the passage of said hanlde therethrough but which prevents the passage of said enlarged portion therethrough and said cover being proportioned in relation to said upper end of said container so that said cover remains engaged with said container when said enlarged portion is in said container and said brush and said container with said cover in engagement with said upper end of said container are suspended by said handle but so that said cover may be removed manually from said upper end of said container; and said container having a projection at its lower end which fits within said opening in said cover and frictionally engages the inner surface of the wall of said opening when said cover is removed from said upper end of said container and is disposed at said lower end of said container whereby said cover forms a supporting base for said container and stably maintains said container with said member therein in a position in which said hanlde extends vertically with the lower surface of said cover engaging a support.

* * * * *

UNITED STATES PATENT AND TRADEMARK OFFICE

CERTIFICATE OF CORRECTION

PATENT NO. : 4,776,456

DATED : October 11, 1988

INVENTOR(S) : Lewis

It is certified that error appears in the above-identified patent and that said Letters Patent is hereby corrected as shown below:

Col. 2, line 26, "rris-" should read --bris--;

Col. 4, line 25, "hanlde" should read --handle--;

Col. 4, line 44, "hanlde" should read --handle--.

Signed and Sealed this

Seventh Day of March, 1989

*Attest:*

DONALD J. QUIGG

*Attesting Officer*

*Commissioner of Patents and Trademarks*